US006302000B1

(12) United States Patent
Smith

(10) Patent No.: US 6,302,000 B1
(45) Date of Patent: Oct. 16, 2001

(54) NUT AND BOLT STARTER HAVING IMPROVED VERSATILITY

(76) Inventor: James H. Smith, 102 Alabama Pl., Wanerobias, GA (US) 31093

( * ) Notice: Subject to any disclaimer, the term of this patent is extended or adjusted under 35 U.S.C. 154(b) by 0 days.

(21) Appl. No.: 09/645,564

(22) Filed: Aug. 25, 2000

(51) Int. Cl.[7] ..... B25B 13/06
(52) U.S. Cl. ..... 81/121.1; 81/13
(58) Field of Search ..... 81/121.1, 13, 177.2, 81/177.6, 487, 488

(56) References Cited

U.S. PATENT DOCUMENTS

| | | | | |
|---|---|---|---|---|
| 2,372,930 | * | 4/1945 | Bovee | 81/64 |
| 2,722,148 | * | 11/1955 | Woyton | 294/99.2 |
| 2,796,101 | * | 6/1957 | Hasemann et al. | 81/64 |
| 3,507,172 | * | 4/1970 | Smith | 81/13 |
| 3,706,154 | * | 12/1972 | Luebbers et al. | 43/53.5 |
| 4,356,852 | * | 11/1982 | Smith | 81/460 |
| 4,566,357 | * | 1/1986 | Carossino | 81/177.2 |
| 5,642,647 | * | 7/1997 | Peruski | 81/13 |

* cited by examiner

*Primary Examiner*—Joseph J. Hail, III
*Assistant Examiner*—David B. Thomas
(74) *Attorney, Agent, or Firm*—Bacon & Thomas

(57) ABSTRACT

A tool for holding nuts or bolts while being moved to a desired position opposite a complementary bolt or nut includes a shaft made of steel spring wire having a handle at one end, the wire terminating at the other end in a loop having a diameter slightly smaller that the diameter of a nut or bolt to be held by the loop, the loop being shaped so that, when a nut or bolt is fitted into the loop, the loop will grip the nut or bolt with sufficient force to hold it as it is brought into a desired position. The diameter of the wire is less than 0.070 inches, and preferably 0.063 or 0.060 inches, so that the shaft will have sufficient flexibility to enable the tool to fit into curved as well as linear spaces, while still holding a nut or bolt securely. The end of the loop terminates in a hook or U-shape, permitting the tool to easily be formed on a kick press without the need for special tooling and greatly simplifying manufacture of the tool. Finally, the handle of the tool is formed with a central passage into which the end of the shaft is fitted and secured by an easily removable fastening element such as an Allen screw so that other similar tools may share the same handle to form a modular tool system.

7 Claims, 1 Drawing Sheet

NUT AND BOLT STARTER HAVING IMPROVED VERSATILITY

BACKGROUND OF THE INVENTION

1. Field of the Invention

This invention relates to improvements in the tool described in U.S. Pat. No. 3,507,172, and in particular to a nut and bolt starter consisting of a wire having a diameter of 0.070 or less, a handle at one end of the shaft, and a nut or bolt head engaging element formed by an appropriately shaped loop at the other end of the shaft, the loop terminating in a unshaped section.

In addition, the invention relates to a modular tool system that includes a common handle to which can be fitted tools of the above type with different loop diameters and is shapes, as well as sockets or bits corresponding to those of a conventional socket wrench.

2. Description of Related Art

The tool disclosed in U.S. Pat. No. 3,507,172 provides a convenient way to handle nuts and bolts in situations where there is not enough space to permit the mechanic to hold a nut or bolt while its complementary bolt or nut is threaded into position from the opposite side of the members being joined.

As disclosed in the above-cited patent and illustrated in FIG. 1, the tool includes a shaft 1 made of steel spring wire having a diameter of 0.090 inches and a handle 2 at one end, the wire terminating at the other end in a loop 3 having a diameter slightly smaller that the diameter of a nut or bolt 4 to be held by the loop. When the loop 3 is expanded slightly, the shape of the loop is such that the nut or bolt 4 is gripped sufficiently tightly by the loop to permit the loop to hold the nut or bolt as it is moved into a desired position opposite the bolt or nut 5 to be threaded into or onto the nut or bolt 4. The tool described in the above-cited patent has the advantage of simple construction and yet is extremely useful because of its ability to position nuts and bolts in spaces that are completely inaccessible to conventional wrenches, and that are far smaller than the human hand. Nevertheless, the inventor of the present invention, who is also the inventor of the tool described in the previous patent, has observed to disadvantages of the prior tool. The first is that the prior tool cannot be used to access areas where there is significant curvature, because of the relative stiffness of the 0.090 inch spring wire used in its construction. The second is that the tip of the loop end of the shaft of the prior tool is reversely bent in on itself by a 360° angle to form a second loop 6, which is said to obviously prevent inadvertently hooking other parts during use, but which turns out to complicate manufacture of the tool because it makes it impossible to manufacture the tool on a kick press.

SUMMARY OF THE INVENTION

It is accordingly a first objective of the invention to provide a tool for the convenient handling of nuts and bolts when the nuts and bolts are to be held in cramped or crowded spaces, and which is capable of extending into curved passages or around obstacles.

It is a second objective of the invention to provide a tool of the type having a flexible shaft that ends in a loop, and yet that can be manufactured on a kick press without the need for special tooling.

It is a third objective of the invention to provide a modular tool system that includes a handle capable of accommodating tools of the above type having different diameters and head shapes, and in addition sockets or other hand tool drivers, bits, or heads.

These objectives are accomplished, in accordance with the principles of a preferred embodiment of the invention by providing a tool of the above-described type that includes a shaft made of steel spring wire having a diameter of less than 0.070 inches and a handle at one end, the wire terminating at the other end in a loop having a diameter slightly smaller that the diameter of a nut or bolt to be held by the loop, the loop being shaped so that, when a nut or bolt is fitted into the loop, the loop will grip the nut or bolt with sufficient force to hold it as it is brought into a desired position.

The inventor has found that by using a wire of less than 0.070 inches, and preferably 0.063 or 0.060 inches, the shaft will have sufficient flexibility to enable the tool to fit into curved as well as linear spaces, while still holding a nut or bolt securely.

Preferably the end of the loop terminates in a hook or U-shape, permitting the tool to easily be formed on a kick press without the need for special tooling and greatly simplifying manufacture of the tool.

In addition, the handle of the tool is preferably formed with a central passage into which the end of the shaft is fitted and secured by an easily removable fastening element such as an Allen screw. As a result, tools having different diameters or differently shaped loops, or even socket drivers, bits, or other tool heads may be fitted into the handle, resulting in an extremely versatile modular tool system. To facilitate identification of the various tools, the shafts of the tools may be color coded.

DETAILED DESCRIPTION OF THE PREFERRED EMBODIMENTS

Figure 1:
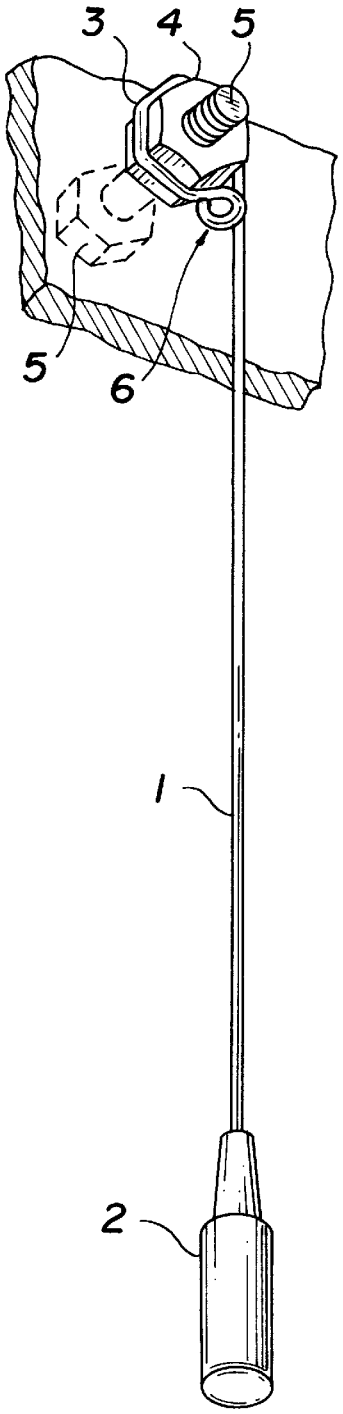
FIG. 1 (PRIOR ART)
FIG. 1 is an isometric view of a prior art nut or bolt handling tool.
Figure 2:
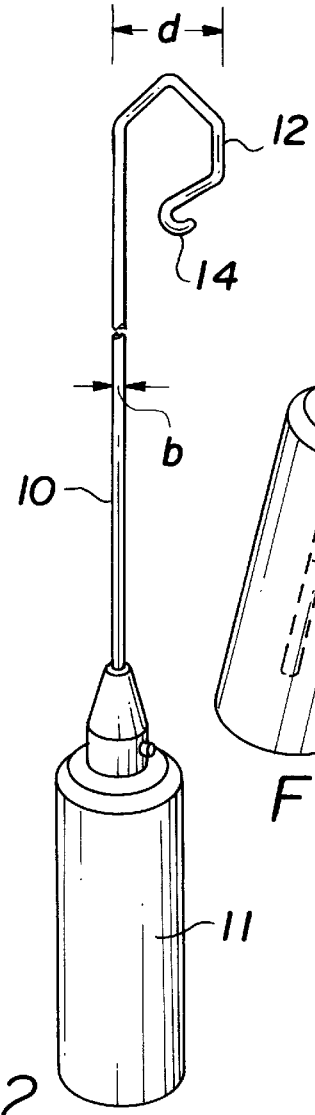
FIG. 2 is an isometric view of a nut or bolt handling tool constructed in accordance with the principles of a preferred embodiment of the invention.
Figure 3:
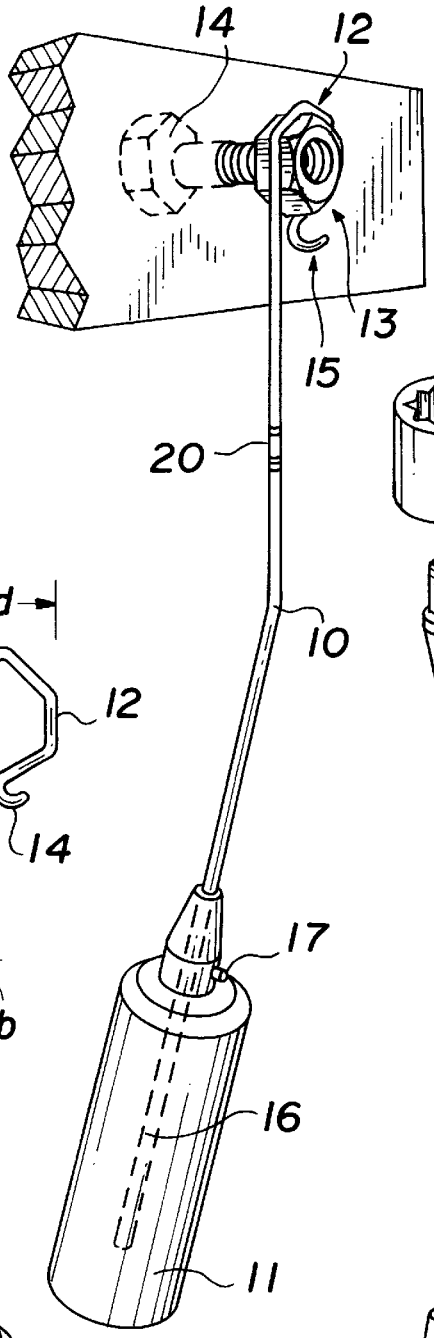
FIG. 3 is an isometric view illustrating the manner in which the tool of FIG. 2 is used to hold a nut or bolt.

As illustrated in FIGS. 2 and 3, the tool of the preferred embodiment of the invention includes a shaft 10 made of steel spring wire having a diameter b of less than 0.070 inches, and preferably equal to 0.063 or 0.060 inches, so as to have sufficient flexibility to enable the shaft to be bent around curves and obstacles. At one end of the shaft 10 is a handle 11, and at the other end of the shaft is a loop 12 having a dimension d slightly smaller that the diameter of a nut or bolt 13 to be held by the loop. Despite the flexibility of the shaft, the shape of the loop 12 and diameter of the wire is such that nut or bolt 13 will be gripped tightly as it is positioned opposite complementary bolt or nut 14 in order to hold the nut or bolt 13 during fastening.

As illustrated , loop 12 has five sides so as to accommodate a hexagonal nut or bolt 13, one side being omitted, although those skilled in the art will appreciate that loop 12 could have other shapes, including a square shape. In addition, dimension d may be varied depending on the size of the nuts or bolts, with the larger wire diameter b of 0.063 inches being preferred for larger nuts and bolts of, for example, greater than ⅜ inch, and the smaller wire diameter b of 0.060 inches being preferred for smaller nuts and bolts.

Loop 12 preferably terminates in a hook or unshaped section 15. While there is some danger that the hook may snag, since the end of the hook extends generally in a direction perpendicular to the longitudinal axis of the shaft, the chance of hooking or snagging an object is minimal, while the benefits obtained by including the hook, i.e., the above-mentioned ability to form the tool on a kick press without the need for special tooling, is substantial.

Figure 4:
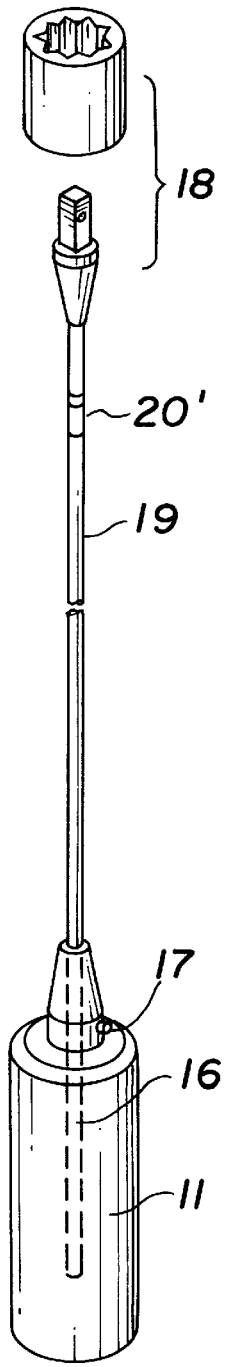
FIG. 4 is an isometric view showing the manner in which the tool of FIG. 2 may be replaced by a socket driver to form a modular tool system.

The tool of the preferred invention is adapted to form part of a modular tool system. This is accomplished by including in the handle 11 a central passage 16 for insertion of the shaft 10, and a releasable fastening means such as allen screw 17 for securing the shaft to the handle. As a result, the preferred tool can easily be exchanged for tools arranged to accommodate nuts and bolts of different diameters, as well as socket drivers such as the socket driver 18 illustrated in FIG. 4. So long as the diameter of the shaft 19 of the socket driver or other tool 18 illustrated in FIG. 4 is approximately identical to wire diameter b of the tool illustrated in FIG. 2, the tool can easily be fitted into the passage 16 and secured by allen nut 17 to the same handle 11 as is illustrated in FIG. 2.

Finally, in order to more easily distinguish one size of tool from another, particularly under poor lighting conditions, the tools may further include color coded or otherwise distinguishable markings 20,20' situated anywhere on the respective shafts 10,19 of the tools.

Having thus described a preferred embodiment of the invention in sufficient detail to enable those skilled in the art to make and use the invention, it will nevertheless be appreciated that numerous variations and modifications of the illustrated embodiment may be made without departing from the spirit of the invention, and it is intended that the invention not be limited by the above description or accompanying drawings, but that it be defined solely in accordance with the appended claims.

What is claimed is:

1. A tool for facilitating handling of nuts and bolts by gripping them as they are maneuvered into a desired position, comprising:

a shaft made of spring steel wire terminating in a loop adapted to fit over and grip a head of a nut or bolt; and a handle fitted onto an opposite end of the shaft, wherein said shaft has a diameter of less than 0.070 inches.

2. A tool as claimed in claim 1, wherein said shaft has a diameter of 0.063 inches.

3. A tool as claimed in claim 1, wherein said shaft has a diameter of 0.060 inches.

4. A tool as claimed in claim 1, wherein said handle includes a central passage into which said shaft is inserted, said shaft being secured to said handle by an easily removable fastening means.

5. A tool as claimed in claim 4, wherein said fastening means is an alien screw.

6. A tool as claimed in claim 4, wherein said tool is part of a modular tool system that includes a socket driver having a driver shaft that fits into said central passage of said handle.

7. A tool as claimed in claim 1, wherein said loop terminates in a section having a u-shape, thereby enabling said tool to be formed in a kick press.

* * * * *

UNITED STATES PATENT AND TRADEMARK OFFICE

CERTIFICATE OF CORRECTION

PATENT NO. : 6,302,000 B1
DATED : October 16, 2001
INVENTOR(S) : James H. Smith

It is certified that error appears in the above-identified patent and that said Letters Patent is hereby corrected as shown below:

Title page,
Item [76], the inventor's city of residence should be -- Warner Robins -- not "Wanerobias".

Signed and Sealed this

Twenty-third Day of April, 2002

*Attest:*

*Attesting Officer*

JAMES E. ROGAN
*Director of the United States Patent and Trademark Office*